US005800629A

United States Patent [19]

Ludwig et al.

[11] Patent Number: 5,800,629

[45] Date of Patent: Sep. 1, 1998

[54] PIPE SYSTEM CLEANING AND IN-LINE TREATMENT OF SPENT CLEANING SOLUTION

[75] Inventors: Jerome H. Ludwig, Paradise Valley; Myron Shenkiryk, Phoenix; Dan Temple, Phoenix; Edward Fyfe, Phoenix, all of Ariz.

[73] Assignee: H.E.R.C. Products Incorporated, Phoenix, Ariz.

[21] Appl. No.: 812,273

[22] Filed: Mar. 6, 1997

[51] Int. Cl.[6] ..... B08B 9/02; C23G 1/02; C23G 1/14; C23G 5/02

[52] U.S. Cl. ..... 134/22.11; 134/22.13; 134/22.14; 134/27

[58] Field of Search ..... 134/22.11, 22.13, 134/22.14, 22.17, 22.9, 27, 28, 29, 3, 10, 41; 210/698, 752

[56] References Cited

U.S. PATENT DOCUMENTS

| | | | |
|---|---|---|---|
| 1,194,542 | 8/1916 | Raymond | 134/169 C |
| 1,892,093 | 12/1932 | Battistella | 134/10 |
| 2,029,232 | 1/1936 | Green | 137/625.29 |
| 2,619,974 | 12/1952 | Daley et al. | 134/56 |
| 2,990,303 | 6/1961 | Pickett et al. | 134/27 X |
| 3,003,899 | 10/1961 | Eberhart et al. | 134/27 X |
| 3,094,131 | 6/1963 | Williams | 134/98 |
| 3,169,545 | 2/1965 | Kolling | 137/209 |
| 3,182,670 | 5/1965 | Howell | 134/107 |
| 3,281,268 | 10/1966 | Martin | 134/10 |
| 3,417,763 | 12/1968 | Fjermestad et al. | 134/58 R |
| 3,424,688 | 1/1969 | Boiko et al. | 134/22.1 |
| 3,527,609 | 9/1970 | Vinso | 134/3 |
| 3,667,487 | 6/1972 | Schoenbeck et al. | 134/108 |
| 3,798,066 | 3/1974 | Evans | 134/108 |
| 3,833,417 | 9/1974 | Griparis | 134/27 X |
| 3,969,255 | 7/1976 | Connelly, Jr. | 510/253 |
| 4,025,359 | 5/1977 | Connelly, Jr. | 134/3 |
| 4,109,703 | 8/1978 | Babish et al. | 165/1 |
| 4,161,979 | 7/1979 | Stearns | 165/95 |
| 4,220,550 | 9/1980 | Frenier et al. | 510/264 |
| 4,276,185 | 6/1981 | Martin | 510/188 |
| 4,398,552 | 8/1983 | Tanaka et al. | 134/57 R |
| 4,430,128 | 2/1984 | Frenier et al. | 134/3 |
| 4,541,945 | 9/1985 | Anderson et al. | 510/253 |
| 4,623,399 | 11/1986 | Frenier | 134/3 |
| 4,636,327 | 1/1987 | Frenier et al. | 134/3 |
| 4,780,150 | 10/1988 | Andersen et al. | 134/3 |
| 4,789,406 | 12/1988 | Holder et al. | 134/3 |
| 4,806,169 | 2/1989 | Späne et al. | 134/3 |
| 4,818,298 | 4/1989 | Shishkin et al. | 134/22.11 |
| 4,872,919 | 10/1989 | Bucher et al. | 134/3 |
| 4,906,384 | 3/1990 | Hamilton | 210/697 |
| 4,971,631 | 11/1990 | Sallee et al. | 134/3 |
| 5,045,211 | 9/1991 | Hamilton | 210/697 |
| 5,045,352 | 9/1991 | Mueller | 427/235 |
| 5,108,514 | 4/1992 | Kisner | 134/22.1 |
| 5,143,102 | 9/1992 | Blaul | 134/58 R |
| 5,199,995 | 4/1993 | Shoji et al. | 134/2 |
| 5,360,488 | 11/1994 | Hieatt et al. | 134/22.11 |
| 5,362,328 | 11/1994 | Gardiner et al. | 118/726 |
| 5,492,629 | 2/1996 | Ludwig et al. | 210/698 |
| 5,527,395 | 6/1996 | Perry et al. | 134/3 |

FOREIGN PATENT DOCUMENTS

| | | |
|---|---|---|
| 11700 | 10/1955 | Germany . |

*Primary Examiner*—Jill Warden
*Assistant Examiner*—Saeed T. Chaudhry
*Attorney, Agent, or Firm*—Wood, Herron & Evans, L.L.P.

[57] ABSTRACT

A process for pipe system cleaning and in-line treatment of spent pipe system cleaning solution prior to disposal. A cleaning solution is added to a fouled pipe system to clean the pipe system of scale or deposits. The spent cleaning solution is recirculated through the cleaned pipe system and a treatment agent is added to the recirculating spent cleaning solution. The treatment agent is recirculated until the spent cleaning solution is environmentally safe for disposal. The in-line treatment process minimizes the volume of treated spent cleaning solution and minimizes the time required to treat the spent cleaning solution.

10 Claims, 1 Drawing Sheet

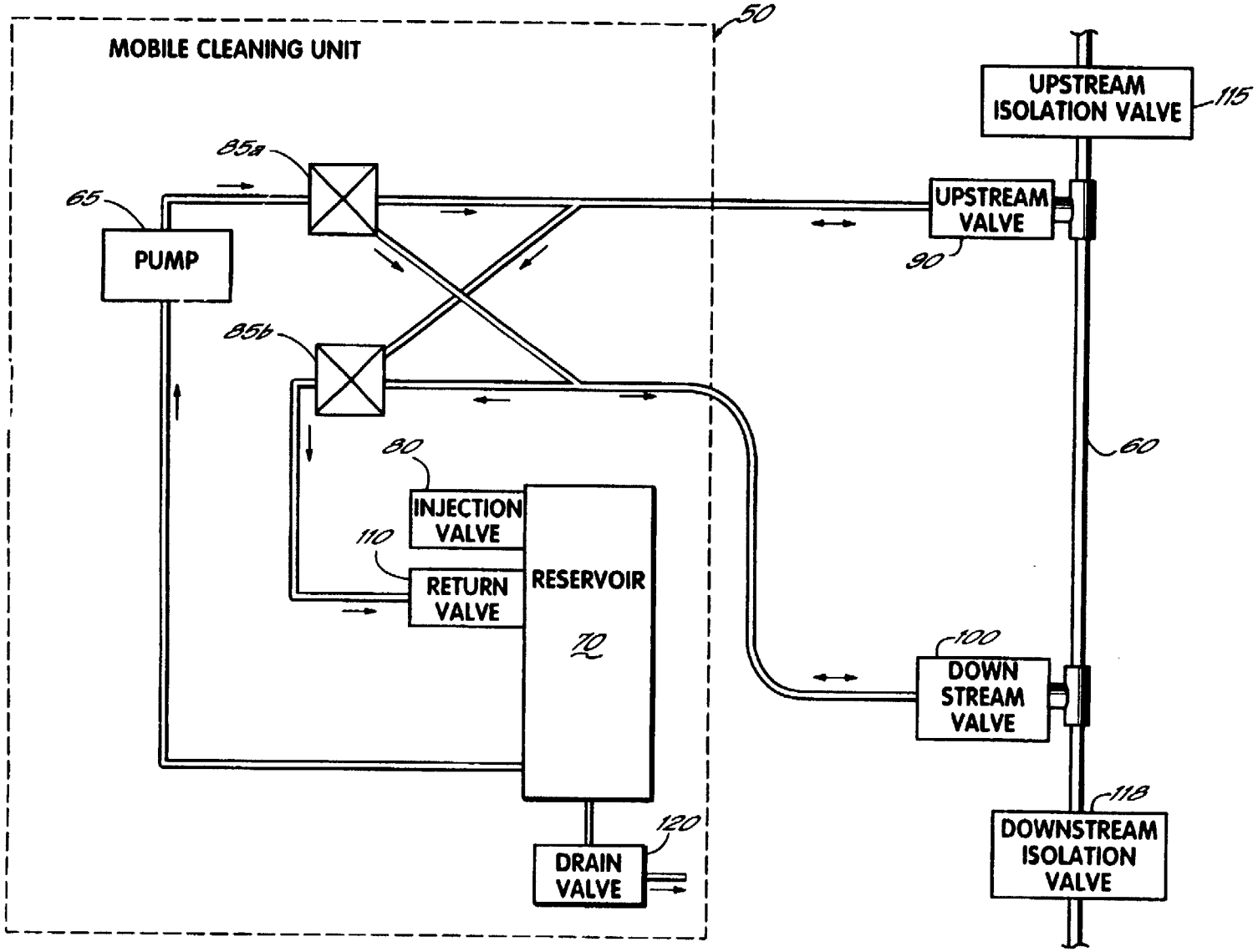
UPSTREAM ISOLATION VALVE
115
UPSTREAM VALVE
90
60
DOWN STREAM VALVE
100
DOWNSTREAM ISOLATION VALVE
118
50
MOBILE CLEANING UNIT
RESERVOIR
70
INJECTION VALVE
80
RETURN VALVE
110
DRAIN VALVE
120
PUMP
65
85a
85b

PIPE SYSTEM CLEANING AND IN-LINE TREATMENT OF SPENT CLEANING SOLUTION

FIELD OF THE INVENTION

This invention relates to a process for pipe system cleaning and in-line treatment of spent pipe system cleaning solution prior to disposal.

BACKGROUND OF THE INVENTION

The method disclosed in U.S. Pat. 5,360,488 ('488), which is assigned to the assignee of this invention and is hereby incorporated by reference, employs flushing or displacing a spent cleaning solution with fresh system water to remove it from the cleaned system prior to placing the system back into service. The method results in diluting the spent cleaning solution with system water during flushing due to the lack of "plug flow," particularly in larger diameter pipe systems. The net result is an increase in the volume of the waste stream to be treated and disposed of, and an increase in the time required to carry out the procedure. Also, the reservoir or chemical tank size limits the volume of spent cleaning solution that can be displaced. This is particularly important when cleaning long sections or large diameter pipe systems when several tankfuls of the diluted displaced spent cleaning solution may be required. In most cases, the spent cleaning solution, when neutralized to a pH of 6–8, may be disposed of directly to sanitary sewer systems.

Many kinds of distribution, transmission, or other piping systems develop various types of deposits, resulting in undesirable blockage or corrosion of the systems. Examples include chemical process lines, in situ mining transfer lines, automatic sprinkler lines, potable water distribution systems including underground, residential, commercial or industrial systems, gas transmission lines, fire water distribution systems, vacuum waste lines, irrigation systems, waste lines, and related valves, fittings, and hydrants.

Scale or deposits in pipes may be removed by various acidic, basic, or neutral cleaning solutions. The fouled cleaning solutions may require treatment prior to disposal. Acidic and basic cleaning solutions normally must be neutralized prior to disposal, while neutral cleaning solutions may require oxidative, reductive or other treatment. Heavy metals that may be present must be removed, for example, by sulfide or phosphate precipitation and subsequent filtration or centrifugation. There is a need for an improved process for the treatment of spent cleaning solutions employed in the cleaning of various piping systems.

SUMMARY OF THE INVENTION

The invention provides a method of pipe system cleaning and in-line treatment of a spent pipe system cleaning solution prior to disposal. A fouled pipe system is cleaned with a cleaning solution by circulating the cleaning solution through the pipe system. A treatment agent is added to the circulating spent cleaning solution to render the spent cleaning solution environmentally safe. The selection of treatment agent depends upon the chemical properties of the spent cleaning solution. Typical treatment agents are acids, bases, oxidizing agents, and reducing agents. Treatment agents can also be used that would cause the pipe scale to precipitate or form particulate material, which could be removed by subsequent filtration or centrifugation. In a preferred embodiment, the treatment agent is added to the reservoir of a mobile cleaning unit which receives the spent cleaning solution for circulation. Upon treatment completion, the treated spent cleaning solution is removed from the pipe system for filtration and/or disposal.

BRIEF DESCRIPTION OF THE FIGURE

The FIGURE is a schematic representation of a mobile cleaning unit used for pipe system cleaning and in-line treatment of spent cleaning solution.

DETAILED DESCRIPTION

Referring to the FIGURE, a mobile cleaning unit 50 is connected to an isolated pipe 60 to be cleaned. For example, the mobile unit and circulation method described in the '488 patent and co-pending application Ser. No. 08/547,099 may be used to clean the pipe system and these disclosures are incorporated herein by reference. A pump 65 circulates cleaning solution that is added to the reservoir 70 in the mobile cleaning unit 50 through an injection valve 80. A pair of diverter valves **85*a*, 85*b* in the pipe system is selectively regulated so that solution flow through the isolated pipe 60 may be reversed to facilitate cleaning the pipe 60. The cleaning solution is circulated from the reservoir 70, into an upstream valve 90 connected to an upstream end of pipe 60 to be cleaned, through the pipe 60, out a downstream valve 100 connected to a downstream end of pipe 60, and is returned by a return valve 110 to the reservoir 70. Circulation is continued until the pipe 60** is cleaned, evidenced by cessation of carbon dioxide gas, for example, when carbonate-containing scale is cleaned. Aqueous inhibited muriatic acid is typically recirculated to remove scale produced by iron oxide and sediment associated with sulfate-reducing and iron bacteria, as disclosed in the method of cleaning potable water distribution systems described in the '488 patent.

At the end of the cleaning cycle, the spent cleaning solution usually has a pH in the range of 0 to 1. Prior to disposal to a sanitary sewer or another suitable waste site as nonhazardous waste, the spent cleaning solution must be neutralized to a pH of 6–8 or otherwise treated to be rendered environmentally safe.

Incorporating the techniques of this invention, at the end of the cleaning cycle circulation of the spent cleaning solution is continued while a treatment agent is injected through the injection valve 80 into the reservoir 70 of the mobile cleaning unit 50. The treatment agent is added to the reservoir 70 until the desired pH of the spent cleaning solution is obtained or other treatment is completed. Treatment may be monitored at an upstream end of the pipe 60 through an upstream isolation valve 115. Similarly, treatment may be monitored at a downstream end of the pipe 60 through a downstream isolation valve 118.

The treated spent cleaning solution may then be discharged to waste by opening a drain valve 120 from the reservoir 70. The cleaned water distribution system is likewise flushed with fresh system water directly to waste prior to disconnecting the pipe 60, now cleaned, from the mobile cleaning unit 50.

Spent acidic cleaning solutions may be neutralized with a variety of basic materials, such as sodium hydroxide, sodium carbonate, sodium bicarbonate, potassium hydroxide, ammonium hydroxide, calcium carbonate, calcium hydroxide, calcium oxide, magnesium oxide, ammonia, organic amines, and the like. These may be added as aqueous solutions or as solids to the reservoir 70.

Spent basic cleaning solutions may be neutralized by the addition of a variety of acidic neutralizing materials in a similar manner. Mineral acids such as hydrochloric acid, nitric acid, sulfuric acid, phosphoric acid, sulfamic acid, and the like and mixtures thereof, or organic acids such as formic acid, glycolic acid, acetic acid, citric acid, sulfonic acids and the like and mixtures thereof, may be employed to neutralize the spent basic cleaning solutions employed in the cleaning of various pipe systems.

Spent neutral cleaning solutions containing a hazardous species may be rendered nonhazardous by addition of an oxidizing or reducing agent. For example, if the spent treatment solution contains hydrogen sulfide, an oxidizing agent such as potassium permanganate may be added to render the spent cleaning solution nonhazardous. Heavy metals that may be present must be removed, for example, by sulfide or phosphate precipitation and subsequent filtration or centrifugation.

The objectives and other advantages of this invention will become apparent in view of the following examples.

EXAMPLE 1

Two hundred feet of an above ground two-inch diameter PVC aqua ammonia process transfer line that was essentially plugged with a hard calcium carbonate deposit was cleaned with an acidic cleaning solution. As stated above, the cleaning solution was circulated through the plugged pipe using a mobile cleaning unit as described in co-pending patent application Ser. No. 08/547,099 or the '488 patent. This type of open loop system allowed for the controlled removal of carbon dioxide gas that was generated during the acidic cleaning process. When generation of carbon dioxide ceased, the pipe was clean. The cleaning solution, still strongly acidic, was neutralized by adding 25% aqueous sodium hydroxide solution to the reservoir with continued circulation of the spent cleaning solution until the solution reached pH 7. The neutralized spent cleaning solution was then pumped to the disposal site and the system was flushed with water prior to placing the PVC transfer pipe back into service.

EXAMPLE 2

Ten hundred and fifteen feet of a four-inch diameter potable water distribution system was cleaned with an acidic cleaning solution. A mobile cleaning unit of the type described in Example 1 was connected to a fire hydrant at one end of the isolated section to be cleaned and a tap at the other end. Upon completion of cleaning, circulation of the spent acidic cleaning solution continued and 25% aqueous sodium hydroxide solution was added to the reservoir of the mobile cleaning unit until the spent acidic cleaning solution was neutral. The neutralized spent cleaning solution was then pumped to waste. The cleaned potable water system was flushed with system water prior to being placed back into service.

EXAMPLE 3

Four hundred feet of a four-inch diameter potable water distribution system, heavily tuberculated with iron and sulfate reducing bacteria-derived blockage, was cleaned with an acidic cleaning solution. A mobile cleaning unit of the type described in Example 1 was used. The mobile cleaning unit was connected to two fire hydrants at either end of the isolated section to be cleaned. After the section was cleaned, the spent acidic cleaning solution continued to circulate through the system and a 25% solution of sodium hydroxide was added to the mobile cleaning unit reservoir until the spent solution was neutralized. The neutralized spent cleaning solution was then pumped to waste. The cleaned potable water system was flushed with system water prior to being placed back into service.

Other variations or embodiments of this invention will become apparent to one of ordinary skill in this art in view of the above description, and the foregoing embodiments are not to be construed as limiting the scope of this invention.

What is claimed is:

1. A method of pipe system cleaning and in-line treatment of a spent pipe system cleaning solution prior to disposal comprising:

cleaning a pipe system with a cleaning solution to form a spent cleaning solution;

recirculating said spent cleaning solution through the cleaned pipe system;

adding a treatment agent to said recirculating spent cleaning solution to render said spent cleaning solution environmentally safe;

recirculating said spent cleaning solution containing said treatment agent until said spent cleaning solution is environmentally safe; and removing said environmentally safe spent cleaning solution from said pipe system for disposal.

2. The method of claim 1 wherein a spent basic cleaning solution is neutralized with an acid selected from the group consisting of mineral acids and organic acids and mixtures thereof.

3. The method of claim 2 wherein said mineral acids are selected from the group consisting of hydrochloric, nitric, sulfuric, phosphoric, and sulfamic acid.

4. The method of claim 2 wherein said organic acids are selected from the group consisting of formic, glycolic, acetic, citric, and sulfonic acid.

5. The method of claim 1 wherein an acidic spent cleaning solution is neutralized with a base selected from the group consisting of sodium hydroxide, sodium carbonate, sodium bicarbonate, potassium hydroxide, ammonium hydroxide, calcium carbonate, calcium hydroxide, calcium oxide, magnesium oxide, ammonia, and organic amines.

6. The method of claim 5 wherein said base is selected from the group consisting of a solid and an aqueous solution.

7. The method of claim 1 wherein said spent cleaning solution is treated to remove a hazardous species by treating with an agent selected from the group consisting of an insolubilizing agent, a precipitating agent, a flocculating agent, an oxidizing agent and a reducing agent.

8. The method of claim 1 wherein said treatment agent is added to a reservoir of a mobile cleaning unit which receives said spent cleaning solution for recirculation.

9. The method of claim 1 wherein said cleaning solution and said treatment agent meets ANSI/NSF Standard 60 requirements for potable water distribution systems.

10. The method of claim 1 wherein said pipe system is selected from the group consisting of:

a water distribution system;
a water transmission system;
a chemical process line;
an in situ mining transfer line;
an automatic sprinkler line;
a gas transmission line; and
a waste line.

* * * * *